US012066213B2

(12) United States Patent
Zhou et al.

(10) Patent No.: US 12,066,213 B2
(45) Date of Patent: Aug. 20, 2024

(54) PREFABRICATED WALL WITH VENTILATION MECHANISM

(71) Applicant: A&C Future Inc, Newport Beach, CA (US)

(72) Inventors: Zhuangboyu Zhou, Santa Ana, CA (US); Jiuqi Wang, Tustin, CA (US); Keguan Zou, Irvine, CA (US); Sichen Li, Irvine, CA (US); Han Qin, Newport Beach, CA (US); Jiayang Qin, Newport Beach, CA (US)

(73) Assignee: A&C Future Inc, Newport Beach, CA (US)

( * ) Notice: Subject to any disclaimer, the term of this patent is extended or adjusted under 35 U.S.C. 154(b) by 185 days.

(21) Appl. No.: 17/839,391

(22) Filed: Jun. 13, 2022

(65) Prior Publication Data

US 2023/0400201 A1 Dec. 14, 2023

(51) Int. Cl.

| | |
|---|---|
| ***F24F 7/013*** | (2006.01) |
| ***E04B 1/70*** | (2006.01) |
| ***E04C 2/52*** | (2006.01) |
| ***F24F 7/00*** | (2021.01) |
| ***F24F 11/00*** | (2018.01) |
| ***F24F 13/08*** | (2006.01) |
| ***F24F 13/12*** | (2006.01) |
| ***F24F 13/28*** | (2006.01) |

(52) U.S. Cl.

CPC ..... *F24F 7/013* (2013.01); *E04B 1/7076* (2013.01); *E04C 2/521* (2013.01); *F24F 13/085* (2013.01); *F24F 13/12* (2013.01); *F24F 13/28* (2013.01); *F24F 2007/0025* (2021.01); *F24F 11/0001* (2013.01); *F24F 2221/17* (2013.01)

(58) Field of Classification Search

CPC .. F24F 7/013; F24F 13/12; F24F 13/28; F24F 2007/0025; F24F 2221/17; E04C 2/521; E04B 1/7076

See application file for complete search history.

(56) References Cited

U.S. PATENT DOCUMENTS

| | | | | |
|---|---|---|---|---|
| 5,120,273 | A * | 6/1992 | Lin | F24F 13/18 454/212 |
| 9,109,389 | B1 * | 8/2015 | Crittenden | B01D 53/14 |
| 9,493,979 | B1 * | 11/2016 | Crittenden | E06B 5/125 |
| 9,719,291 | B1 * | 8/2017 | Crittenden | E06B 7/082 |
| 9,745,793 | B1 * | 8/2017 | Crittenden | E06B 7/082 |
| 9,803,417 | B1 * | 10/2017 | Crittenden | F24F 13/12 |
| 10,190,360 | B1 * | 1/2019 | Crittenden | E06B 5/00 |
| 10,190,361 | B1 * | 1/2019 | Crittenden | F24F 11/72 |

(Continued)

FOREIGN PATENT DOCUMENTS

| | | | | |
|---|---|---|---|---|
| CN | 212104636 U | * 12/2020 | | E04B 2/00 |

*Primary Examiner* — Andrew J Triggs
(74) *Attorney, Agent, or Firm* — Elizabeth Yang

(57) ABSTRACT

A prefabricated wall with a ventilation mechanism is provided in the present invention. Generally, it includes a ventilation mechanism that lets air exchange in a room from the wall. People can adjust the inlet airflow with a controller. The ventilation mechanism has several holes on the outer surface which face to outside. The outdoor air can pass through the holes and filter into the inner room, consequently fulfilling the function of the ventilation duct. The room equipped such a prefabricated wall does not rely on an HVAC system to have fresh air exchange.

11 Claims, 4 Drawing Sheets

(56) References Cited

U.S. PATENT DOCUMENTS

| | | | | |
|---|---|---|---|---|
| 11,253,805 | B1 * | 2/2022 | Jones | B01D 46/0049 |
| 11,255,121 | B1 * | 2/2022 | Crittenden | E06B 3/72 |
| 11,835,260 | B1 * | 12/2023 | Crittenden | F24F 13/20 |
| 2023/0400201 | A1 * | 12/2023 | Zhou | F24F 13/28 |

* cited by examiner

PREFABRICATED WALL WITH VENTILATION MECHANISM

FIELD OF THE INVENTION

The present invention relates generally to a prefabricated wall and, particularly to with a prefabricated wall with a ventilation mechanism, which has resulted in a flexible adjustment of the volume of the airflow and control on the open and close of the ventilation.

BACKGROUND OF THE INVENTION

With the development of internet and social media, an individual online broadcasting or video conference is increasingly popularized in modern society. Not only celebrities or professional actors but also common people throughout all the industries are streaming online. It can be determined that broadcasting or video conference online will spread more widely in the future with the blooming of innovations in communication and the internet.

Plumbing is one of the most important processes in construction. It costs a lot of time and labor but may not be durable for a long time. In the plumbing or ventilation process, an HVAC system has been generally included to deal with the problem of ventilation. HVAC stands for Heating, Ventilation, and Air Conditioning. HVAC refers to the different systems used for moving air between indoor and outdoor areas, along with heating and cooling both residential and commercial buildings. Therein, Air vents process or system makes the most impact in the house. A qualified ventilation configuration may keep the house warm and cozy in the winter and feeling cool and fresh in the summer. In addition, the ventilation construction plays an essential role in filtering outdoor dust and cleaning indoor air to keep mold free and maintain fresh air circulating at optimal comfort levels.

Usually, the ventilation mechanism in the art has an opening for the exchange between indoor and outdoor air, optionally combined a filter. Such ventilation mechanism has a significant drawback. For example, dust buildup will be deposit around the opening over times when the outdoor air flows through the opening, consequently blocking the opening. In addition, the general placement of the filter in the ventilation system will deteriorate the filtering efficiency.

To obtain fresh air with a good quality, we combine the ventilation with an HVAC system, but it may take up much space height in a room. On another hand, it will cost much on electricity usage. Users cannot adjust ventilation volume individually in each room. The problem is that the centralized ventilation system will occupy too much space and resources. Fresh air pass through too long before they get to a given space. Such design seems neat in construction but has many defects.

Thus, there is an urgent need for facilitating the ventilation and enhancing the efficiency and flexibility thereof.

SUMMARY OF THE INVENTION

In this invention, a prefabricated wall is provided. A ventilation mechanism is combined with a prefabricated wall. The mechanism allows airflow directly to pass through the wall from outside, and will be easier to control room by room. Since the mechanism has been pre-set, it will reduce many costs in the plumbing process.

One of the objectives of the present invention is to solve the filtration failure and vent clogging of ventilation system in the art.

Another of the objectives of the present invention is to reduce the cost of installing the integrated air conditioner system.

This invention can not only be applied to houses but also can be applied to some buildings. Especially for some skyscrapers, HVAC will take much place and waste the floor height. In an HVAC system, the ventilation pipe is relatively thick depending on the estimated human flow rate. This problem is brought about by the centralized ventilation system. If each wall of the building is able to 'breath', then the ventilation pipe will not need to be such thick.

Specifically, the present invention can be presented in the following forms:

A prefabricated wall with ventilation mechanism, the prefabricated wall comprising:

a main body with at least one window;

at least one ventilation mechanism located on the main body, the ventilation mechanism having an outer surface with at least one holes, and a board piece with some corresponding holes; and a cover with a slot thereon for inletting airflow from the outside, and covering the ventilation mechanism, wherein the ventilation mechanism controls the open and close of the ventilation and changes the volume of the airflow, via adjusting the locations of the corresponding holes of the board piece.

In another aspect, the ventilation mechanism is positioned at the four corners of the prefabricated wall.

In another aspect, the main body is composed as multiple boxes.

In another aspect, wherein the boxes are connected via bolts, screws or pins.

In another aspect, the boxes are filled with filling materials, selected from soundproof or heat insulation materials.

In another aspect, the ventilation mechanism has a filter attached to the board piece.

In another aspect, the ventilation mechanism has a paired gear of rack and pinion.

In another aspect, the pinion is mounted on the side edge of the board piece.

In another aspect, the racked is installed with each end thereof aligned to the pinion.

In another aspect, a back-and-forth movement of the rack cogging on the pinion leads to an adjustment of the overlap.

In another aspect, the board piece has a connecting rod to control the movement of the board piece.

In another aspect, the ventilation mechanism has at least one fan installed between the outer surface and the cover.

In another aspect, the prefabricated wall has an air-container system, integrated with the ventilation mechanism.

BRIEF DESCRIPTION OF THE DRAWINGS

The invention will now be described, by way of example, with reference to the accompanying drawings, in which.

Like reference numerals refer to like parts throughout the various views of the drawings.

DETAILED DESCRIPTION OF THE INVENTION

Figure 1:
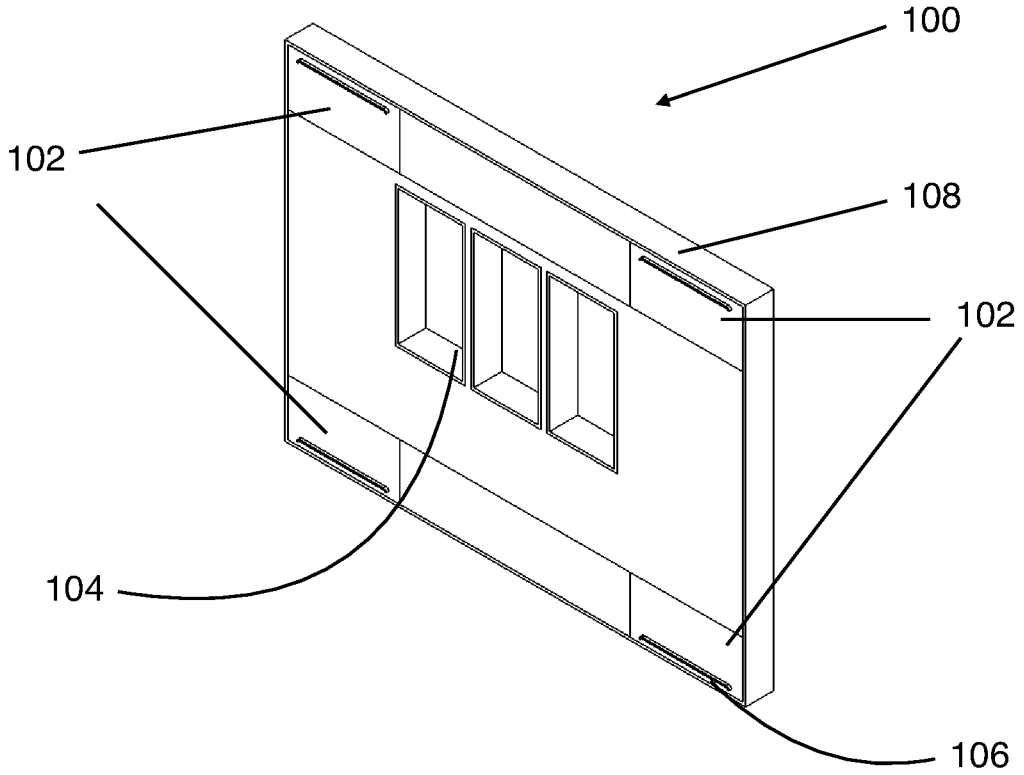
FIG. 1 illustrates the schematic view of a prefabricated wall with a ventilation mechanism, in accordance with an embodiment of the present invention.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

At the outset, it should be clearly understood that like reference numerals are intended to identify the same structural elements, portions, or surfaces consistently throughout the several drawing figures, as may be further described or explained by the entire written specification of which this detailed description is an integral part. The drawings are intended to be read together with the specification and are to be construed as a portion of the entire "written description" of this invention as required by 35 U.S.C. § 112.

As an embodiment of the present invention illustrated in FIG. 1, a prefabricated wall assembly 100 of several modules is provided. The prefabricated wall 100 comprises a main body 108, at least one ventilation mechanism 102, and at least one window 104. Generally, the main body looks like regular wall panels with structure inside, overall. Window 104 can be set in a specific module, which is suitable for being installed in the prefabricated wall 100. The main body 108 can be assembled with the top and bottom modules, including other functional parts, like warm or cool units. Adhesive or screws are not limited, but tightly fixed with different modules to integrate them. The window space is reserved for future use. The entire prefabricated wall 100 is designed as boxes, and they can be overlayed one by one. Preferably, the ventilation mechanism 102 is well positioned at the four corners of the prefabricated wall 100. Each ventilation mechanism has a cover with a slot 106 to cover thereon, letting fresh airflow enter the room from the interspace. Since the slot 106 is a small invisible design, it will not have a bad aesthetic effect on the prefabricated wall. When the window is closed, people are still able to have a nice atmosphere inside depending on the fresh air from the ventilation mechanism 102. In extreme temperature periods, the closed window will keep the room at an appropriate temperature and the ventilation mechanism 102 let oxygen and fresh air enter the room.

Such a prefabricated wall with a ventilation function in the embodiment offers fresh air directly from the wall, preferably from the outside of room. When the ventilation process is decomposed into part by part, it will solve the set-up problem and cost issues. The main body 108 will be like regular walls in the art. Preferably, the prefabricated wall can be divided into more pieces depending on need such as some layers of "boxes" stacked with each other by some mechanism locks. Thus, it's flexible and detachable.

In a manufacturing process for the prefabricated wall assembly, the four corners of the wall are preset with a ventilation mechanism. For example, the four corners may be dented with a pre-measured depth for the ventilation mechanism, so that the overall appearance of the prefabricated walls is a flat "panel" shape when looking outside.

Figure 2A:
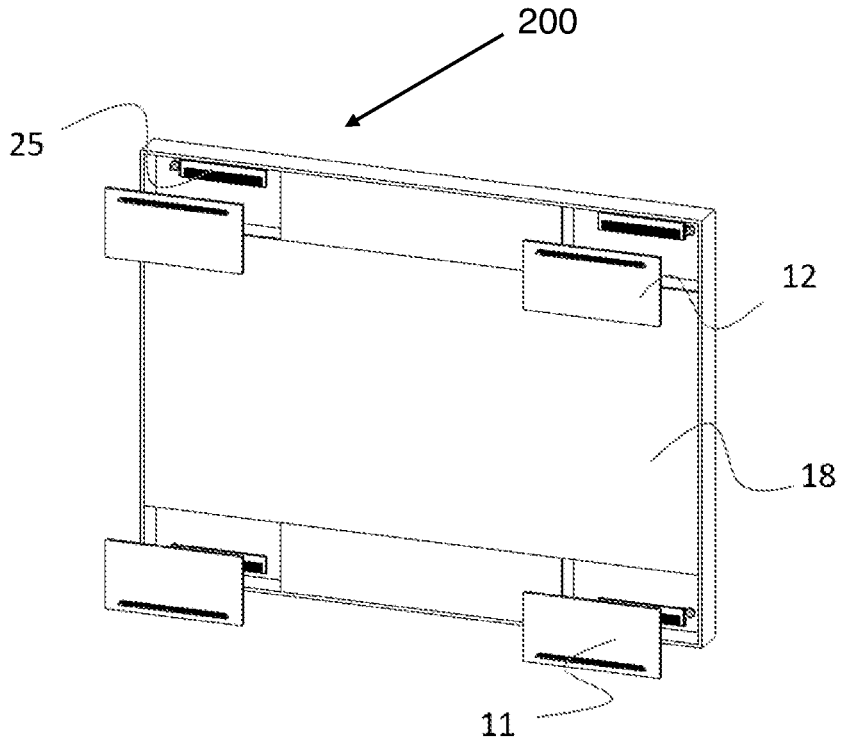
FIG. 2*a* illustrates the internal view of the ventilation mechanism when the cover has been removed, in accordance with an embodiment of the present invention.

FIG. 2*a* shows another embodiment of the present invention. Combined FIG. 2*a* clearly shows the exploded view of a ventilation mechanism in the prefabricated wall 200. In the embodiment, the ventilation mechanism 25 has a cover 12 to cover itself. Similar, the cover 12 has a slot. When the cover 12 has been removed, it is clear to see internal parts inside the ventilation mechanism 25. This ventilation module realizes the function of exchanging fresh airflow from outside. As the same with air conduit in an HVAC system, the ventilation module is responsible for keeping the oxygen concentration in the room. The difference is that the ventilation wall is a decentralized process for transporting fresh air. There is no need for getting air from the complicated plumbing system and energy consuming, but directly from the exterior walls. Each prefabricated wall 200 face to the outside can exchange air from inside to outside. The constructions of the ventilation mechanism 25 will be discussed in the below.

Figure 2B:
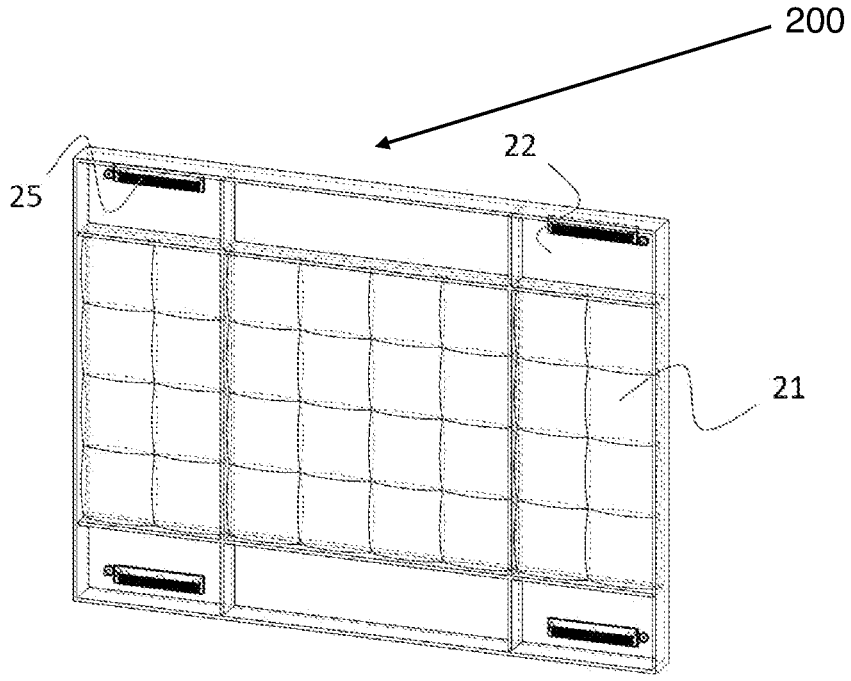
FIG. 2*b* illustrates the structure and fillings inside the wall (No Window Version), in accordance with an embodiment of the present invention.

FIG. 2*b* is the interior of the prefabricated wall 200. The entire prefabricated wall 200 can be divided into parts depending on what kind of module is needed. In this embodiment, the middle part of the prefabricated wall 200 is hollow. Filled in the hollow space are some filling materials 21, including but not limited into soundproof material and cool/heat insulation material, to keep the room quiet and comfortable. The hollow part can be divided into several sections depending on height and transportation requirements. And it also can be interchanged by a window module as shown in FIG. 1. The filling material 21 is also flexible. It can be design as a pyramid shape or other soundproofing design.

In the embodiment shown in FIG. 2*b*, the prefabricated wall 200 is formed with multiple hollow boxes. In this example, the main body has multiple cubic boxes, but the number of the box is not limited. The prefabricated wall 200 can be divided into several boxes for more convenient transportation. Then the assembly of the wall is built on some internal lock mechanism, including bolts, screws, pins, etc. Inside the box, the filling material 21 may be sound-proofing sponges and heat insulation cotton or rubber well-positioned in each box. After the necessary filling has been set up, the prefabricated wall is covered with a panel. The panel can be customized by customers, preferably with a decorative design element. The material of the panel for covering the box can be either metal, plastic, or wood, depending on the requirements.

The cover on the corner for covering the ventilation mechanism can be easily removed for replacing the filter or maintenance of the ventilation part. The cover is connected with the hollow box in many ways. It can be directly fixed on it with some spikes or adhesive material. A hinge can also be applied if there is a convenience need.

Preferably, the top cover 12 is the upper panel for covering the internal ventilation mechanism 25, and the bottom cover 11 is the lower panel which is located at the bottom. The ventilation mechanism 25 inside the prefabricated wall used for controlling the airflow inlet to the room. There is a space 22 inside the prefabricated wall 200 to accommodate the ventilation mechanism. This space 22 also can be pre-set for a fan or some other device to help the air exchange process.

Figure 3A:
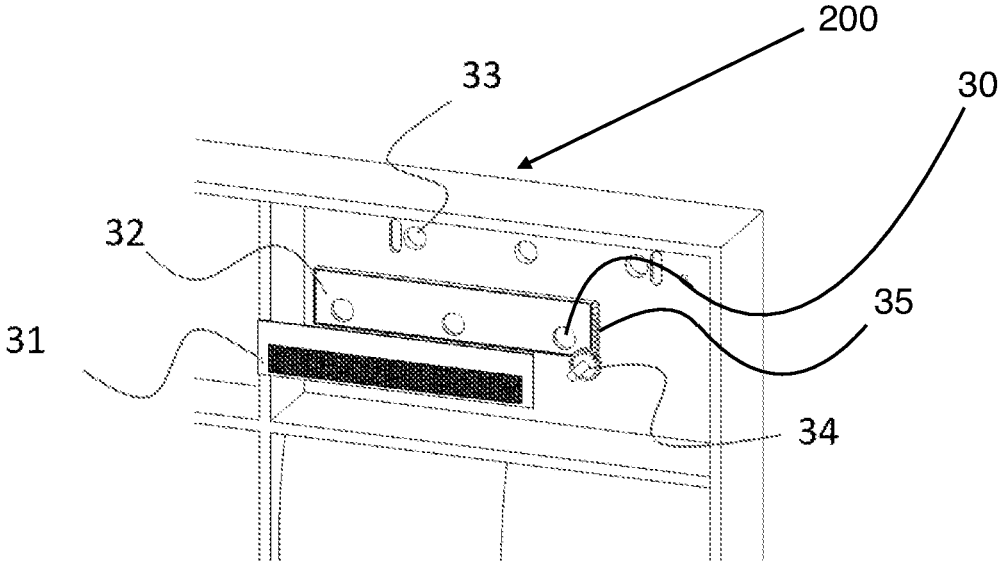
FIG. 3*a* is an explosion view of the mechanism for ventilation, in accordance with an embodiment of the present invention.
Figure 3B:
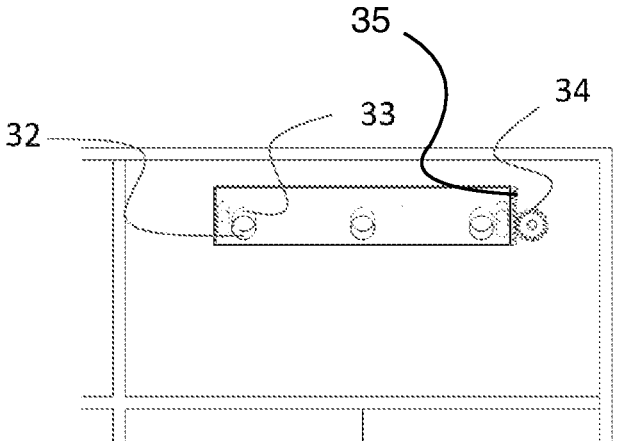
FIG. 3*b* illustrates the details of the ventilation mechanism, in accordance with an embodiment of the present invention.

FIGS. 3*a* and 3*b* illustrates the detailed constructions of the ventilation mechanism 25 shown in the FIG. 2*a* and FIG. 2*b*. The ventilation mechanism is covered by the cover, and has an outer surface facing to outside with some holes 33, and a board piece 32 with some corresponding holes 30, whose location overlaps the holes' 33 location. The locations of the holes 33 may be adjusted to control the extent of the overlaps between the locations of holes 33 and holes 30. Holes 33 are some distributed holes mounted on the outer surface, to let the prefabricated wall 200 be able to get fresh air flow from outside. The location and amount of the holes is not limited. They only need to allow airflow to get inside. Preferably, more than one holes are arranged at intervals in a line. The board piece 32 having the holes 30 corresponding to hole 33 mounted on the outer surface. The amounts of holes 30 and holes 33 are the same. The board piece 32 is movable to be accommodated to position in different locations. When the holes 30 are overlapped with the holes 33 exactly, it will result in the maximum volume of airflow inlet. When moving the board piece 32, the holes' 30 locations tend to be mismatched, consequently bringing about at least partial block areas, which resulting in a block of air flow from outside. The holes 30 will form three ellipses shape and become narrower and narrower. In the end, board piece's 32 holes 30's locations will totally move to the bottom of hole 33, consequently without any overlaps on the holes 33, in that way wherein the ventilation process is stopped. The ventilation mechanism has a filter 31. To prevent dust and other harmful substances from entering the room, there is a filter 31 attached to the board piece 32, which can overlap on the board piece 32. The filter 31 is a replaceable filter used to keep particles from entering the interior of the prefabricated wall 200. Since the cover 12 is designed for maintenance, it will be easier to remove the cover 12 and replace a new filter 31.

When controlling the ventilation mechanism to adjust the air flow, a rack and pinion are integrated into the ventilation mechanism 25. On the right side of the board piece 32, there is a paired gear of rack 34 and pinion 35. Preferably, the pinion 35 is mounted at the side edge of the board piece 32, and accordingly, the rack 34 is installed with each end of the rack 34 aligned to the pinion 35. The back-and-forth movement of the rack 34 cogging on the pinion 35 results in a back-and-forth pressure force to the board piece 32, subsequently leading to a switch between match and mismatch of the holes 33 and holes 30. Therefore, an adjustment and control of air flow has been realized.

Visually shown in FIG. 3*b*, it has presented a view of the process when closing the ventilation, via a movement of the rack 34 on the pinion 35. As introduced above, when ventilation is needed, the holes 33 and holes 30 on the board piece 32 will match, forming an air inlet channel that let the fresh air come in. Optionally, when a minimum of air flow is needed, the partial overlap between holes 33 and holes 30 may be set. Alternatively, the paired gear of rack and pinion 34, 35 is not the only way to control the movement of the board piece 32. It can also be connecting rod, shaft or other connecting mechanisms which enable a back-and-forth movement. For example, the ventilation parts can be linked with a belt drive or a connecting rod, alternatively. Such a mechanism will be able to control all the mechanisms.

In sum, the rack on the pinion will control the system open and close. The controller is not limited to rack and pinion but also can be a hydraulic rod, etc. And ventilation modules all over the corners would also be controlled together by the same ventilation mechanism structures.

Figure 4:
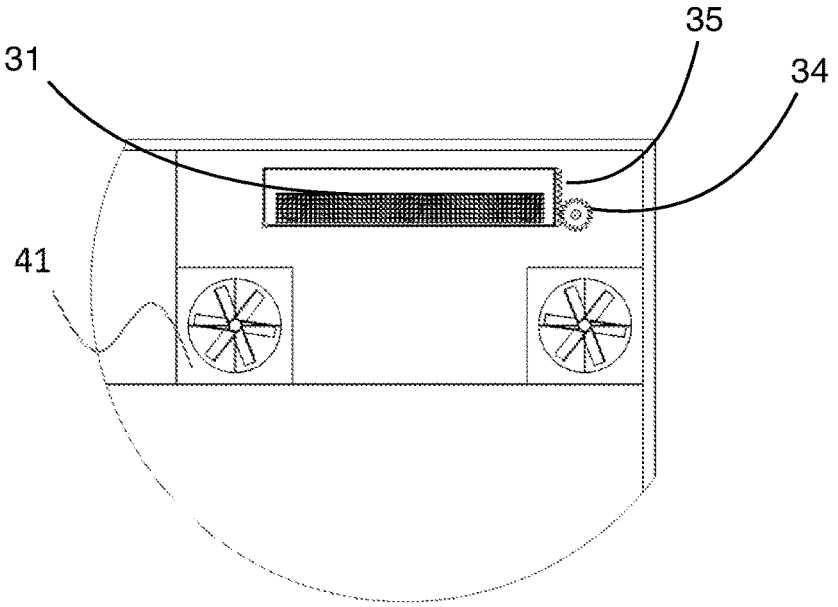
FIG. 4 illustrates the structure combined with an additional fan that reinforces the ventilation function, in accordance with an embodiment of the present invention.

FIG. 4 illustrates another embodiment in which at least one fan is installed in the interior space to help the ventilation process, preferably the fan 41 is installed between the outer surface and the cover. Since the prefabricated wall is modularly fabricated, it is easier to pre-set fans 41 in the ventilation module. The entire prefabricated wall is constructed as a multi-layer box. The ventilation module is also a sealed box. After the cover 12 has been closed, it will close the air transfer from inside to inside (internal air cycle). Therefore, the running of the fans 41 will form a vacuum condition within the box, which transfers the fresh air from outside, and blows them into the room. Adjustment of the spinning speed of the fan will also control the inlet airflow. Preferably, all the fans and controllers will be merged into a control board. Input and output are reserved for the power supply from room wiring.

Figure 5:
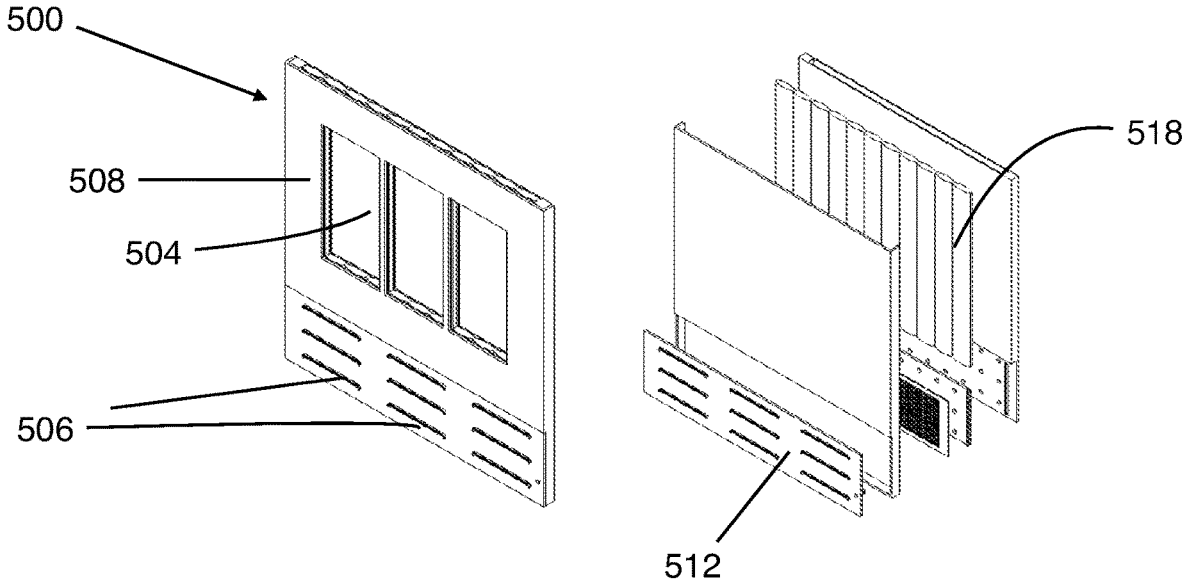
FIG. 5 a variant prefabricated wall integrating the ventilation mechanism with air conditioner system, in accordance with an embodiment of the present invention.

FIG. 5 shows an exploded view of another embodiment of the present invention. The prefabricated wall 500 has multiple different locations of the air vent. Mainly, the prefabricated wall 500 has a main body 508 that is constructed as multiple layers. Optionally, the main body 508 has some windows 504 through the wall. In addition, the prefabricated wall 500 has a cover 512 with some slots 506, and a ventilation mechanism with the constructions with the above embodiments described. In this embodiment shown in the FIG. 5, preferably, the cover 512 and ventilation mechanism are located at the bottom of the main body 508. Furtherly, the prefabricated wall 500 in this embodiment has an air-conditioner system, which is integrated with the ventilation modules. The air-conditioner system has a set of heating/cooling pipes 518. When the airflow inlet from the outside, the heating/cooling pipe 518 can adjust the temperature of the airflow. The volume of inlet airflow can also be adjusted similarly via the movement of the rack and pinion in the ventilation modules, which controls the entire ventilation system.

The invention includes but not limits all the embodiments above. Especially, the parts/modules of the prefabricated wall assembly for different embodiments are interchangeable.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What I claim is:

1. A prefabricated wall with ventilation mechanism, the prefabricated wall comprising:

a main body;

at least one ventilation mechanism located on the main body, the ventilation mechanism having an outer surface with at least one first hole, and a board piece with at least one second hole corresponding to the at least one first hole;

a cover with a slot thereon for inletting airflow from outside, and covering the ventilation mechanism; and an air-conditioner system, integrated with the ventilation mechanism, and the air-conditioner system has a set of heating/cooling pipes located in the main body, wherein the ventilation mechanism controls open and close of ventilation and changes volume of the airflow, via adjusting locations of the at least one second hole of the board piece, and the at least one ventilation mechanism is only positioned at four corners of the prefabricated wall.

2. The prefabricated wall of claim 1, wherein the main body has multiple boxes.

3. The prefabricated wall of claim 2, wherein the multiple boxes are connected via bolts, screws, or pins.

4. The prefabricated wall of claim 2, wherein the multiple boxes are filled with filling materials, selected from soundproof or heat insulation materials.

5. The prefabricated wall of claim 1, wherein the ventilation mechanism has a filter attached to the board piece.

6. The prefabricated wall of claim 1, wherein the ventilation mechanism has a paired gear of rack and pinion.

7. The prefabricated wall of claim 6, wherein the pinion is mounted on a side edge of the board piece.

8. The prefabricated wall of claim 6, wherein the rack is installed with each end thereof aligned to the pinion.

9. The prefabricated wall of claim 6, wherein a back-and-forth movement of the rack cogging on the pinion leads to an adjustment of overlapping the at least one first hole with the at least one second hole.

10. The prefabricated wall of claim 1, wherein the board piece has a connecting rod to control a movement of the board piece.

11. The prefabricated wall of claim 1, wherein the ventilation mechanism has at least one fan installed between the outer surface and the cover.

* * * * *